US006666569B2

(12) United States Patent
Obata

(10) Patent No.: US 6,666,569 B2
(45) Date of Patent: Dec. 23, 2003

(54) BACKLIGHT DEVICE

(75) Inventor: Masato Obata, Niigata (JP)

(73) Assignee: Nippon Seiki Co., Ltd., Niigata (JP)

( * ) Notice: Subject to any disclaimer, the term of this patent is extended or adjusted under 35 U.S.C. 154(b) by 0 days.

(21) Appl. No.: 10/070,952

(22) PCT Filed: Jul. 18, 2001

(86) PCT No.: PCT/JP01/06258

§ 371 (c)(1),
(2), (4) Date: Mar. 13, 2002

(87) PCT Pub. No.: WO02/11106

PCT Pub. Date: Feb. 7, 2002

(65) Prior Publication Data

US 2002/0149943 A1 Oct. 17, 2002

(30) Foreign Application Priority Data

Jul. 31, 2000 (JP) ..... 2000-235240

(51) Int. Cl.[7] ..... F21V 5/02
(52) U.S. Cl. ..... 362/339; 362/331
(58) Field of Search ..... 362/31, 330, 339, 362/555, 551, 561, 800, 23, 29, 327, 329, 235, 331, 340; 349/64, 65

(56) References Cited

U.S. PATENT DOCUMENTS 4,975,807 A * 12/1990 Ohashi ..... 362/23
6,111,622 A * 8/2000 Abileah ..... 349/61
6,341,879 B1 * 1/2002 Skinner et al. ..... 362/295
6,530,670 B2 * 3/2003 Hirayama ..... 362/31

FOREIGN PATENT DOCUMENTS

| | | | |
|---|---|---|---|
| JP | 60-120484 | 8/1985 | |
| JP | 61-92980 | 6/1986 | |
| JP | 5-333333 | 12/1993 | |
| JP | 05333333 A * | 12/1993 | ..... G02F/01/1335 |
| JP | 6-27894 | 2/1994 | |
| JP | 6-314069 | 11/1994 | |
| JP | 10-39778 | 2/1998 | |
| JP | 2000-47175 | 2/2000 | |

* cited by examiner

*Primary Examiner*—Y. My Quach-Lee
*Assistant Examiner*—Peggy A Neils
(74) *Attorney, Agent, or Firm*—McDermott, Will & Emery

(57) ABSTRACT

There is provided a backlight device which is bright and has low unevenness of luminance, and a backlight device 2 is constituted by a translucent sheet 6 having light diffusibility, a light emitting element 5 disposed behind the translucent sheet 6, and a prism sheet 7 disposed between the light emitting element 5 and the translucent sheet 6 and having a prism surface 72 on which plural rows of prism portions 73 each having a pair of inclined surfaces (hem sides B and C) intersecting with each other at a top A1 and a substantially V-shaped section are formed, and a plane surface portion 71 formed on a surface opposite to the prism surface 72, in which the prism sheet 7 is disposed away from the light emitting element 5 and the translucent sheet 6 by distances W1 and W2 so that the prism surface 72 is faced toward the light emitting element 5.

7 Claims, 6 Drawing Sheets

BACKLIGHT DEVICE

TECHNICAL FIELD

The present invention relates to a backlight device for illuminating a panel display body, such as a liquid crystal display panel, from its back.

BACKGROUND ART

Conventionally, for example, as a backlight device for illuminating a liquid crystal display panel from the back, there is often adopted a backlight device called a side light system, which includes a light guide body along the back of the liquid crystal display panel, and a light emitting element arranged at the side of the light guide body, such as a light emitting diode or a fluorescent lamp, and in which light of the light emitting element is made plane emission through the light guide body. This kind of backlight device is very thin and is suitable for brightly illuminating the liquid crystal display panel having a relatively wide area, however, it is difficult to efficiently use the light of the light emitting element because of the structure, and a high luminance light emitting element or a plurality of light emitting elements are required, and there is a tendency that the cost becomes high.

On the other hand, for example, as disclosed in Japanese Patent Unexamined Publication No. 2000-47175 or No. Hei. 10-39778, a just under type of illumination system is also widely adopted in which a liquid crystal display panel is illuminated by a light source disposed just under the liquid crystal display panel. This type of backlight device is superior in that light from the light emitting element can be efficiently used, however, especially in the case where a dot-like light emitting element is used, uneven illumination is apt to occur, and in order to obtain uniform plane emission, it is necessary to secure a distance between the light emitting element and the liquid crystal display panel to a certain degree, and it is not suitable for reduction in size.

Under such circumstances, in the backlight device using the just under type of illumination system, for example, one or plural translucent sheets each being milk-white and having light diffusibility are often used to make the illumination uniform. However, the adoption of such a translucent sheet causes a drop in luminance, and under the existing circumstances, the number of light emitting elements must be increased. Then, it is conceivable to adopt a prism sheet as means for compensating an insufficiency of luminance due to the translucent sheet. A prism sheet in which its one surface is a plane surface and the other surface opposite to the plane surface is a prism surface, is put on the market, plural rows of minute prism portions each having a substantially V-shaped section are formed on the prism surface, the prism surface is normally faced toward the front side (side of the liquid crystal display panel), and the prism sheet is superposed on the front of the translucent sheet and is used. By using the prism sheet as stated above, the light which passes through the translucent sheet and is diffused, is refracted in such a direction as approaches the vertical direction with respect to the liquid crystal display panel to the utmost, and the illumination luminance is raised.

However, in the structure in which the prism sheet is disposed on the translucent sheet so that the prism portion is faced toward the front side, although the illumination luminance is certainly improved, it does not contribute to the equalization of illumination very much, and a sufficient effect can not be obtained for the resolution of the uneven illumination. Thus, it is necessary to take such measures that for example, mask printing of dots or the like is performed for the translucent sheet, or the number of light emitting elements is increased, however, there are demerits that the mask printing of the dots or the like needs a bright light emitting element and unevenness of luminance is apt to occur, and the increase of the light emitting elements causes an increase in cost.

The present invention has been made in view of the problem, and provides a backlight device which is bright and has low unevenness of luminance.

DISCLOSURE OF THE INVENTION

A backlight device according to the present invention includes a translucent sheet having light diffusibility, a light emitting element disposed behind the translucent sheet, and a prism sheet disposed between the light emitting element and the translucent sheet and having a prism surface on which a plurality of prism portions each having at least a pair of inclined surfaces intersecting with each other at a top are formed, and a plane surface portion formed on a surface opposite to the prism surface, in which the prism sheet is disposed away from the light emitting element and the translucent sheet so that the prism surface is faced toward the light emitting element.

Besides, a backlight device according to the present invention includes a translucent sheet having light diffusibility, a light emitting element disposed behind the translucent sheet, and a prism sheet disposed between the light emitting element and the translucent sheet and having a prism surface on which a plurality of prism portions each having at least a pair of inclined surfaces intersecting with each other at a top are formed, and a plane surface portion formed on a surface opposite to the prism surface, in which the prism sheet includes a first prism sheet and a second prism sheet disposed away from each other, a prism surface of the first prism sheet is faced toward the light emitting element, and a prism surface of the second prism sheet is faced oppositely from the first prism sheet.

Besides, a backlight device according to the present invention includes a light emitting element, a prism sheet disposed in front of the light emitting element and having a prism surface on which a plurality of prism portions each having at least a pair of inclined surfaces intersecting with each other at a top are formed, and a plane surface portion formed on a surface opposite to the prism surface, and a translucent sheet disposed in front of the light emitting element and having light diffusibility, in which the prism sheet includes a first prism sheet and a second prism sheet disposed away from each other, a prism surface of the first prism sheet is faced toward the light emitting element, a prism surface of the second prism sheet is faced oppositely from the first prism sheet, and the translucent sheet is disposed behind the second prism sheet and away from the first prism sheet.

Besides, in the backlight device according to the present invention, top edge lines of the respective prism portions are extended in parallel with each other to form a row shape.

Besides, in the backlight device according to the present invention, top edge lines of those are concentrically extended to form a row shape.

Besides, in the backlight device according to the present invention, top edge lines of the prism portions of the first prism sheet and top edge lines of the prism portions of the second prism sheet are extended in parallel with each other.

Besides, in the backlight device according to the present invention, the light emitting element is made of a dot-like light source.

Besides, in the backlight device according to the present invention, the light emitting element is made of a light emitting diode.

BRIEF DESCRIPTION OF THE DRAWINGS

FIGS. 1 to 3 shows a first embodiment in which a backlight device of the present invention is applied to a liquid crystal display panel, wherein FIG. 1 is a sectional view of the liquid crystal display panel, FIG. 2 is a partial enlargement perspective view of a prism sheet in the embodiment, and FIG. 3 is a partial enlargement side view of the prism sheet in the embodiment.

FIGS. 4 to 6 shows a second embodiment in which a backlight device of the present invention is applied to a liquid crystal display panel, wherein FIG. 4 is a sectional view of the liquid crystal display panel, FIG. 5 is a partial enlargement perspective view of a second prism sheet in the embodiment, and FIG. 6 is a partial enlargement side view of first and second prism sheets in the embodiment.

BEST MODE FOR CARRYING OUT THE INVENTION

A first embodiment of the present invention will be described with reference to FIGS. 1 to 3.

Figure 1:
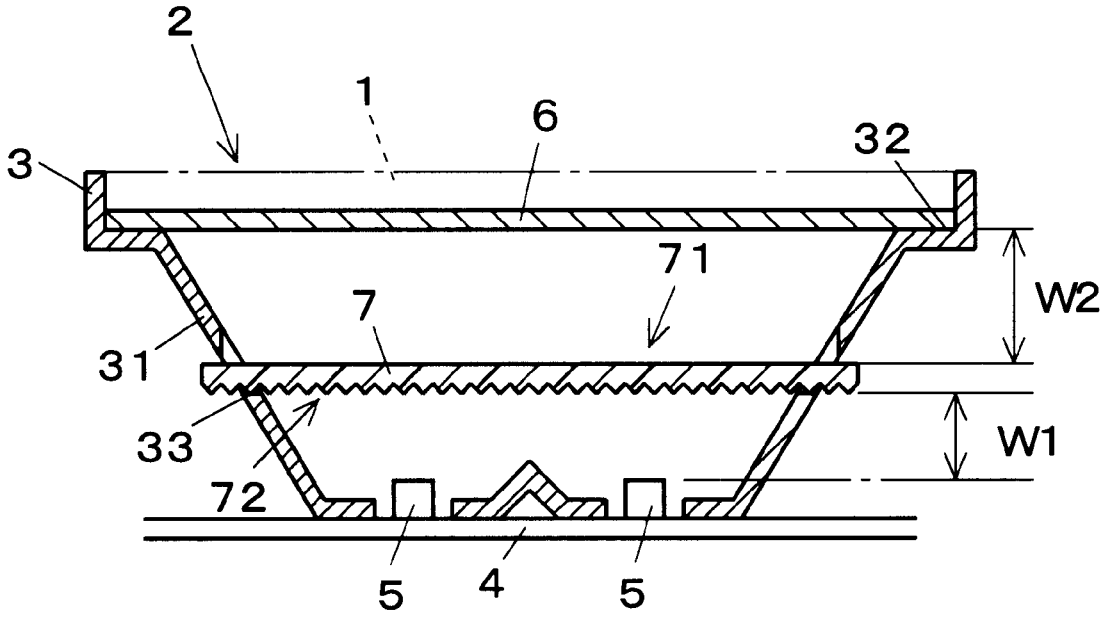

In FIG. 1, although not shown in detail, a liquid crystal display panel 1 is such that polarizing plates (not shown) are bonded to both surfaces of a liquid crystal cell in which a liquid crystal is sealed between a pair of translucent substrates, and for example, a liquid crystal element of a TN type segment display system is used.

A backlight device 2 includes a housing 3 containing the liquid crystal display panel 1 as well, light emitting elements 5 disposed on a circuit substrate 4, a translucent sheet 6 disposed in front of the light emitting elements 5 so as to cover them, and a prism sheet 7 disposed between the translucent sheet 6 and the light emitting element 5, and they are integrated through the housing 3.

The housing 3 is made of whitish synthetic resin having a light shielding property, and has openings corresponding to the liquid crystal display panel 1 and the light emitting elements 5, a side wall portion 31 is shaped to gradually widen toward the liquid crystal display panel 1 from the light emitting elements 5, and a holding portion 32 for positioning and supporting the liquid crystal display panel 1 and the translucent sheet 6 in a stacked state and a holding portion 33 for positioning and supporting the prism sheet 7 are formed at the side wall portion 31.

The light emitting elements 5 are made of, for example, SMD (Surface Mounting Device) type light emitting diodes (dot-like light sources), and in this case, the two elements are disposed while the light emitting surfaces are faced toward the liquid crystal display panel 1. As the light emitting element 5, in addition to the SMD type light emitting diode, a light emitting diode (dot-like light source) with a lead or a linear light source such as a fluorescent lamp can also be used.

The translucent sheet 6 is formed of synthetic resin such as PC or PMMA so as to have, for example, milk white, and is a thin plate having light permeability and light diffusibility, however, as long as a member has the light permeability and the light diffusibility, any material and any color can be selected, and it may be, for example, a substrate made of a transparent thin plate to which printing with the light diffusibility is applied.

The prism sheet 7 is made of a transparent material with achromatic color, and in this embodiment, for example, a film for light control is used. In this prism sheet 7, a surface at the side of the liquid crystal display panel 1 is formed as a plane surface portion 71, and a surface opposite to the plane surface portion 71 is formed as a prism surface 72.

Figure 2:
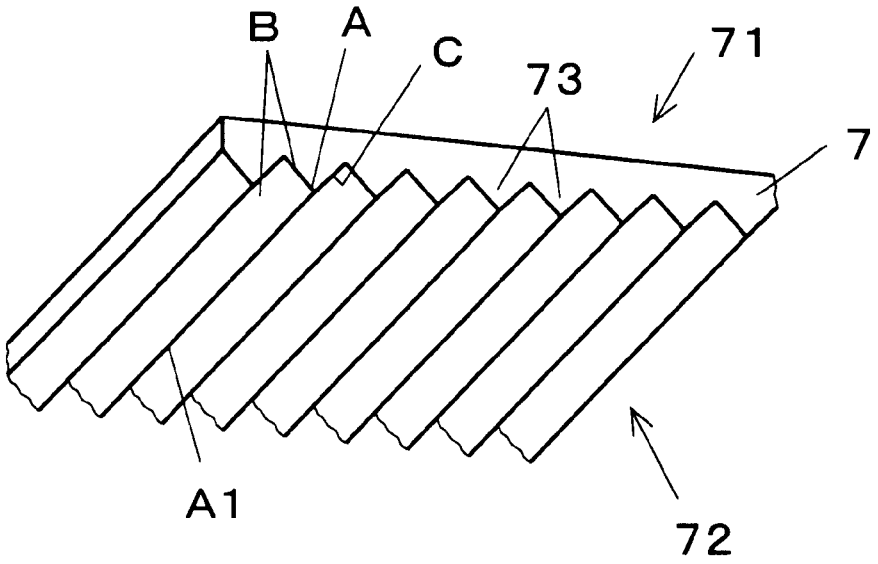
Figure 3:
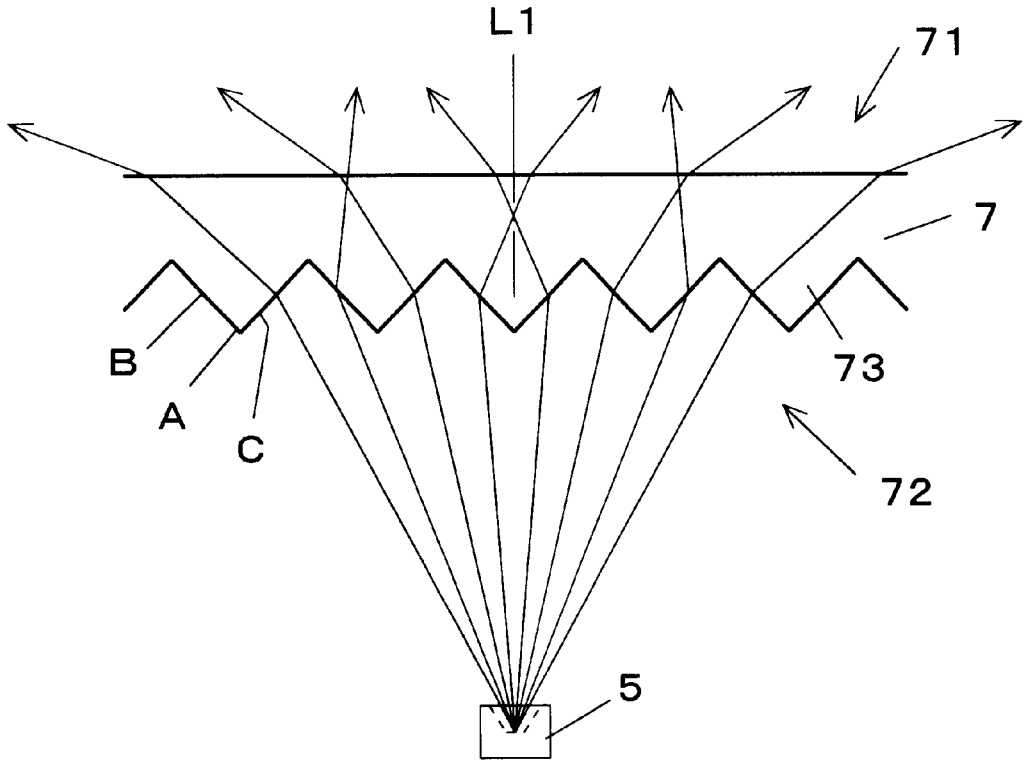

As shown also in FIGS. 2 and 3, a plurality of prism portions 73 protruding toward the light emitting elements 5 are formed on the prism surface 72. The respective prism portions 73 have the same shape, and its sectional shape is a V shape having a top (vertex) A and two hem sides B and C intersecting with each other at the top A. The prism portions 73 having the V-shaped sections as stated above are arranged at constant intervals and regularly in a row shape so that edge lines A1 of the respective tops A are extend in parallel with each other (especially see FIG. 2), and the hem sides B and C extended together with the edge line A1 form inclined surfaces with respect to the light emitting elements 5. An inclined angle of the hem side B, C (inclined surface) is set to, for example, 45 degrees with respect to a normal L1 of the plane surface portion 71, and as described later, light of the light emitting element 5 can be refracted and transmitted. Although the prism portions 73 are enlarged and are illustrated, the interval between the edge lines A1 is about 50 $\mu$m and they are actually minute. Incidentally, the prism sheet 7 is not limited to the type having the minute prism portions 73 as stated above, and a mold of transparent synthetic resin integrally having a prism portion of a suitable size (for example, the illustrated size) may be used.

The prism sheet 7 constructed as stated above is disposed so that the prism surface 72 is faced toward the light emitting elements 5, and is a predetermined distance (described later) away from the light emitting element 5 and the translucent sheet 6 and is positioned substantially midway between them.

In the backlight device 2 constructed as described above, when the light emitting element 5 is turned on, light radially emitted from the light emitting element 5 passes through (transmitted through) the prism sheet 7 as shown in FIG. 3. At this time, light incident on the prism surface 72 is refracted in the direction of going away from the normal L1 of the plane surface portion 71 by the prism portion 73 and enters the prism sheet 7, and when the light entering in this way passes through the plane surface portion 71 of the prism sheet 7 and goes out to the translucent sheet 6, it is further refracted in the direction of going away from the normal L1 by the plane surface portion 71. Incidentally, some light is totally reflected by the prism surface 72 and the plane surface portion 71 and is returned to the light emitting element 5, and such light illuminates the vicinity of the light emitting element 5.

Accordingly, the light of the light emitting element 5 passes through the prism sheet 7 and is refracted in the direction of going away from the normal L1 so that the light is diffused, and by this, the brightness in a space just above the light emitting element 5 and the vicinity is suppressed, and at the same time, the light is diffused in a wide range.

The light diffused by the prism sheet 7 in this way is further diffused when it passes through the translucent sheet 6, forms a substantially uniform emission surface, and illuminates the liquid crystal display panel 1.

Here, a relation of a distance W1 between the light emitting element 5 and the prism sheet 7 with respect to a distance W2 between the prism sheet 7 and the translucent sheet 6 will be described (see FIG. 1 as to the distances W1 and W2). For example, when it is assumed that the height of the backlight device 2 is fixed to a predetermined dimension, there is a tendency that when the distance W1 is made small or the distance W2 is made large, a space just above the light emitting element 5 and the vicinity become dark, and a periphery remote from the light emitting element 5 becomes bright, and on the other hand, when the distance W1 is made large or the distance W2 is made small, the space just above the light emitting element 5 and the vicinity become bright, and the periphery remote from the light emitting element 5 becomes dark. Thus, by suitably adjusting the dimension of the distance W1 within the determined height dimension, the illumination state can be made optimum.

As described above, the backlight device 2 of this embodiment includes the translucent sheet 6 having the light diffusibility, the light emitting elements 5 disposed behind the translucent sheet 6, and the prism sheet 7 disposed between the light emitting elements 5 and the translucent sheet 6 and having the prism surface 72 on which the plural rows of the prism portions 73 each having the pair of inclined surfaces (hem sides B and C) intersecting with each other at the top A1 and the substantially V-shaped section are formed, and the plane surface portion 71 formed on the surface opposite to the prism surface 72, in which the prism sheet 7 is disposed away from the light emitting elements 5 and the translucent sheet 6 by the distances W1 and W2 so that the prism surface 72 is faced toward the light emitting elements 5, whereby area illumination can be carried out by a minimum necessary number of light emitting elements 5, which is bright, suppresses the unevenness of illumination, and is uniform.

Figure 4:
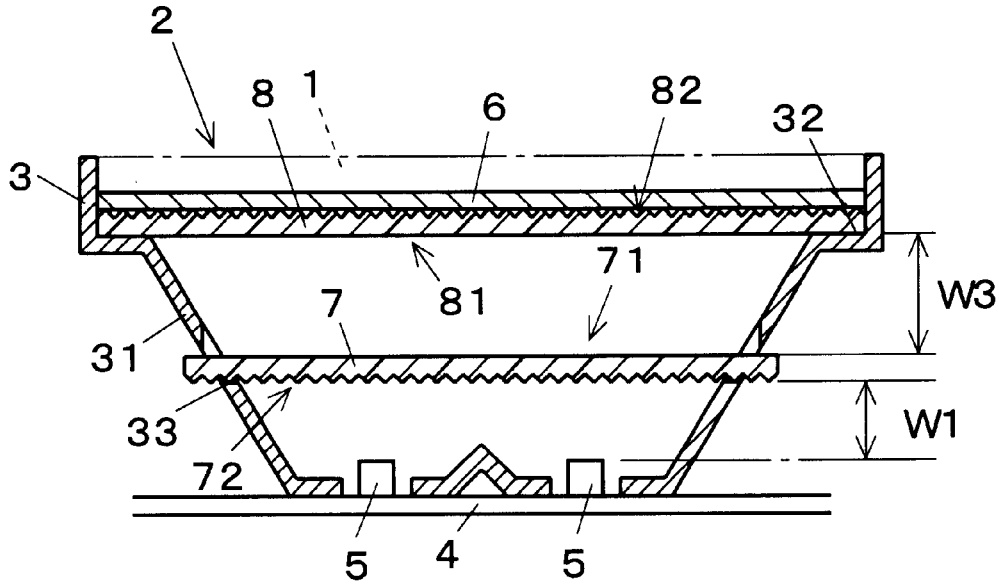

Next, a second embodiment of the present invention will be described with reference to FIGS. 4 to 6.

A housing 3, a circuit substrate 4, light emitting elements 5, a translucent sheet 6, and a prism sheet 7 are the same as those of the first embodiment, however, a second prism sheet 8 is added in addition to the prism sheet (first prism sheet) 7.

Figure 5:
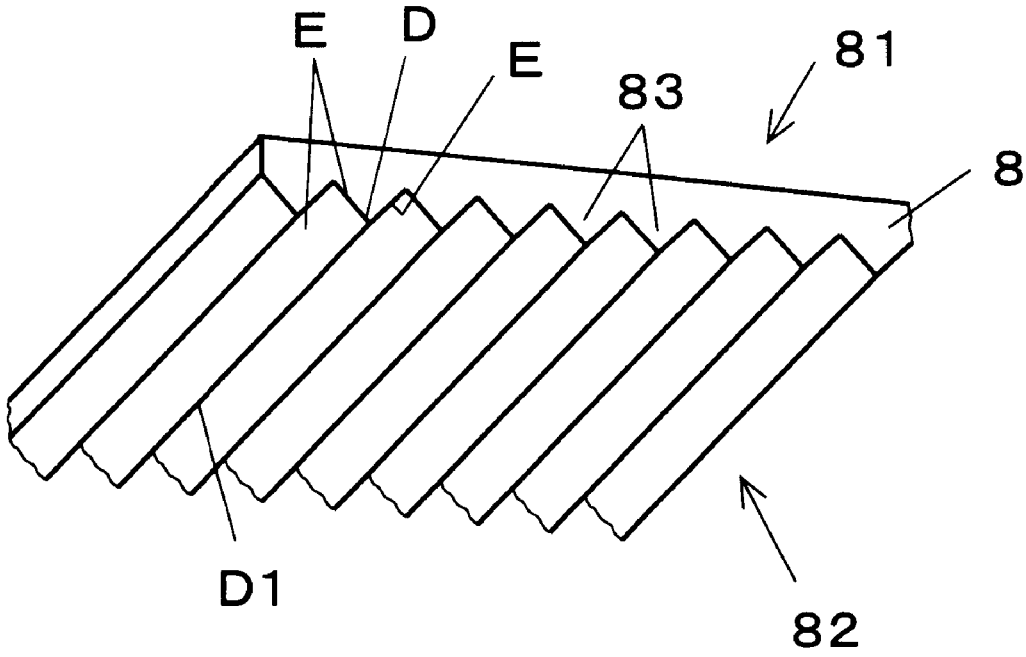
Figure 6:
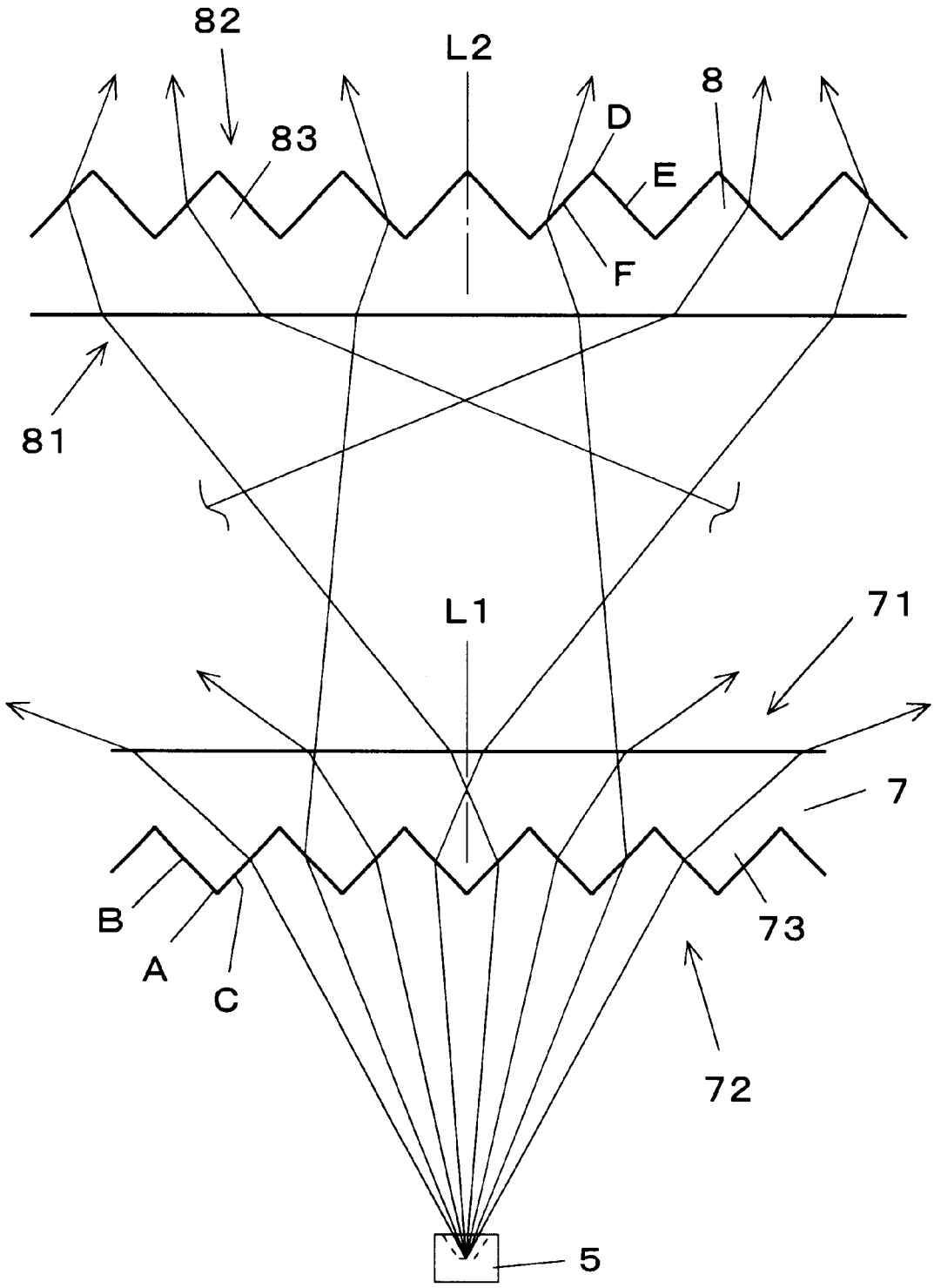

That is, the second prism sheet 8 is made of a sheet of the same material as the first prism sheet 7, though its width dimension is different, and it has a plane surface portion 81 on a surface at the side of the first prism sheet 7, and a prism surface 82 on a surface at a side (side of the liquid crystal display panel 1) opposite to the plane surface portion 81, and as shown also in FIGS. 5 and 6, plural rows of prism portions 83 protruding toward the translucent sheet 6 are formed on the prism surface 82. The respective prism portions 83 have the same shape similarly to the first prism sheet 7, and its sectional shape is a V shape having a top (vertex) D and two hem sides E and F intersecting with each other at the top D. The prism portions 83 having the V-shaped sections as stated above are arranged at constant intervals and regularly in a row shape so that edge lines D1 of the respective tops D are extend in parallel with each other (especially see FIG. 5), and the hem sides E and F extended together with the edge line D1 form inclined surfaces with respect to the translucent sheet 6 (the liquid crystal display panel 1). An inclined angle of the hem side E, F (inclined surface) is set to, for example, 45 degrees with respect to a normal L2 of the plane surface portion 81, and as described later in detail, light diffused through the first prism sheet 7 can be refracted and transmitted as described later. Although the prism portions 83 are enlarged and are illustrated also here, the interval between the edge lines D1 is about 50 $\mu$m and they are actually minute similarly to the first prism sheet 7.

Besides, in the relation between the first and the second prism sheets 7 and 8, the second prism sheet 8 is disposed so that the prism surface 82 is faced oppositely from the prism surface 72 of the first prism sheet 7, and further, it is a predetermined distance W3 away from the first prism sheet 7. Further, the edge line A1 of the top A of the prism portion 73 of the first prism sheet 7 and the edge line D1 of the top D of the prism portion 83 of the second prism sheet 8 are set so that they become parallel with each other.

In the backlight device 2 constructed in this way, when the light emitting element 5 is turned on, as shown in FIG. 6, light radially emitted from the light emitting element 5 first passes through (transmitted through) the first prism sheet 7, and as described in detail in the first embodiment, the first prism sheet 7 refracts the light from the light emitting element 5 in the diffusion direction. The light refracted in this way passes through the second prism sheet 8, and at this time, in the light incident on the plane surface portion 81, the light inclined in the direction of going away from the normal L1 through the first prism sheet 7 is refracted in the direction of approaching the normal L2 of the plane surface portion 81 through the plane surface portion 81, and enters the second prism sheet 8, and when it goes out to the translucent sheet 6 through the prism surface 82 of the prism sheet 8, it is further refracted by the prism portion 83 in the direction of approaching the normal L2.

That is, when the first and the second prism sheets 7 and 8 made of the same material (shape) are used, the edge lines A1 and D1 of the respective prism portions 73 and 83 are made parallel with each other, and further, the first prism sheet 7 is disposed so that the prism surface 72 is faced toward the light emitting element 5, and the second prism sheet 8 is disposed so that the prism surface 82 is faced oppositely from the first prism sheet 7, whereby the first prism sheet 7 refracts the light in the direction of going away from the normal L1 to diffuse the light in a wide range while suppressing the brightness in the space just above the light emitting element 5 and the vicinity, and on the other hand, the second prism sheet 8 refracts the light inclined in the direction of going away from the normal L1 through the first prism sheet 7 in the direction of approaching the normal L2.

By this, the uniformity of the emission surface can be further improved, and especially the brightness of the periphery and the vicinity remote from the light emitting element 5 is improved, and as a result, bright and uniform illumination can be realized by a smaller number of light emitting elements 5.

As described above, the backlight device 2 of this embodiment includes the translucent sheet 6 having the light diffusibility, the light emitting elements 5 disposed behind the translucent sheet 6, and the first and the second prism sheets 7 and 8 disposed between the light emitting elements 5 and the translucent sheet 6 and having the prism surfaces 72 and 82 on which the plural rows of the prism portions 73 and 83 each having the pair of inclined surfaces (the hem sides B and C, and the hem sides E and F) intersecting with each other at the top A1, D1 and the substantially V-shaped section are formed, and the plane surface portions 71 and 81 formed on the surfaces opposite to the prism surfaces 72 and 82, in which the respective prism sheets 7 and 8 are disposed away from each other by a distance W3, the prism surface 72 of the first prism sheet 7 is faced toward the light emitting elements 5, and the prism 82 of the second prism sheet 8 is faced oppositely from the first prism sheet 7, whereby area illumination can be carried out by a minimum necessary number of light emitting elements 5, which is bright, suppresses the unevenness of illumination, and is uniform.

Figure 7:
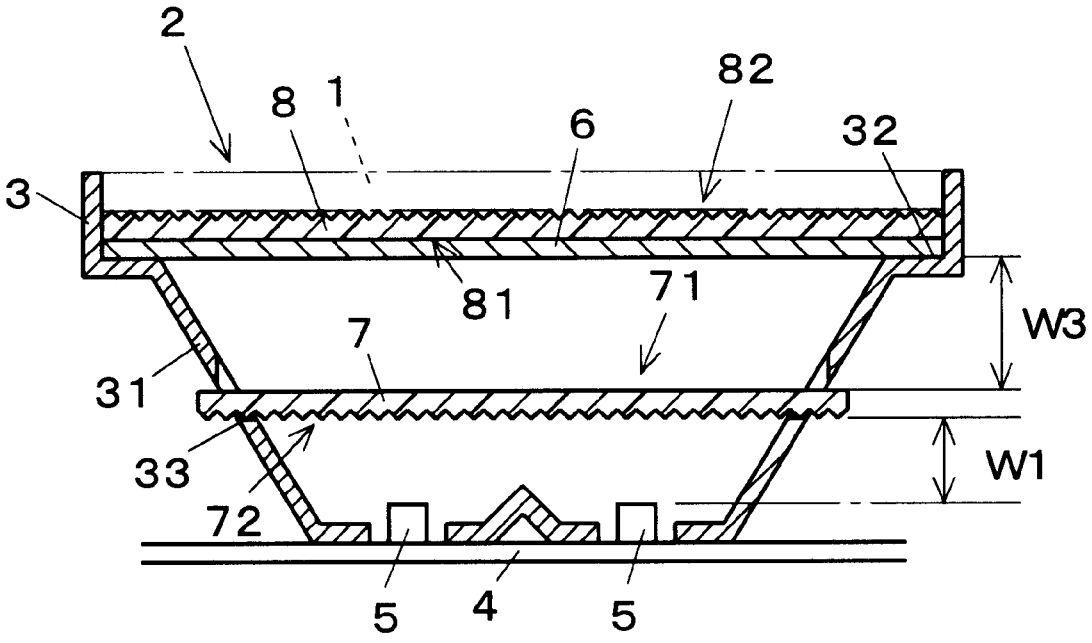
FIG. 7 is a main part side view showing a third embodiment.

Next, a third embodiment of the present invention will be described with reference to FIG. 7. In this embodiment, the structure of the first embodiment is made the base, and the second prism sheet 8 used in the second embodiment is disposed in front of the translucent sheet 6 of the first embodiment (between the translucent sheet 6 and the liquid crystal display panel 1).

That is, there are provided light emitting elements 5, and first and second prism sheets 7 and 8 disposed in front of the light emitting elements 5 and having prism surfaces 72 and 82 on which plural rows of prism portions 73 and 83 each having a pair of inclined surfaces (hem sides B and C, and hem sides E and F) intersecting with each other at tops A1 and D1 and substantially V-shaped sections are formed, and plane surface portions 71 and 81 formed on surfaces opposite to the prism surfaces 72 and 82, in which the respective prism sheets 7 and 8 are disposed away from each other by a distance W3, the prism surface 72 of the first prism sheet 7 is faced toward the light emitting elements 5, the prism surface 82 of the second prism sheet 8 is faced oppositely from the first prism sheet 7, and a translucent sheet 6 is disposed behind the second prism sheet 8 and away from the first prism sheet 7, whereby area illumination can be carried out by a minimum necessary number of light emitting elements 5, which is bright, suppresses the unevenness of illumination, and is uniform, and further, the luminance of emission can be made higher than the backlight device of the first embodiment.

Figure 8:
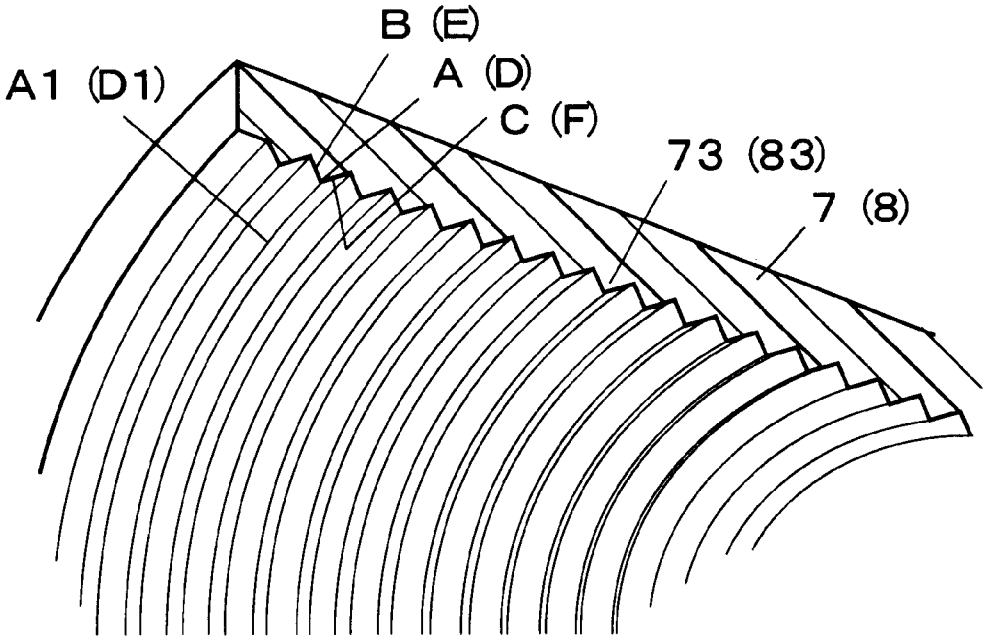
FIG. 8 is a main part perspective view of a prism sheet showing a fourth embodiment.

Incidentally, the first to the third embodiments show the case in which in the respective prism portions 73 and 83, the edge lines A1 and D1 of the tops A and D are extended in parallel with each other, however, for example, as in a fourth embodiment of the present invention shown in FIG. 8, prism sheets 7 and 8 in which edge lines A1 and D1 are concentrically extended may be used.

Figure 9:
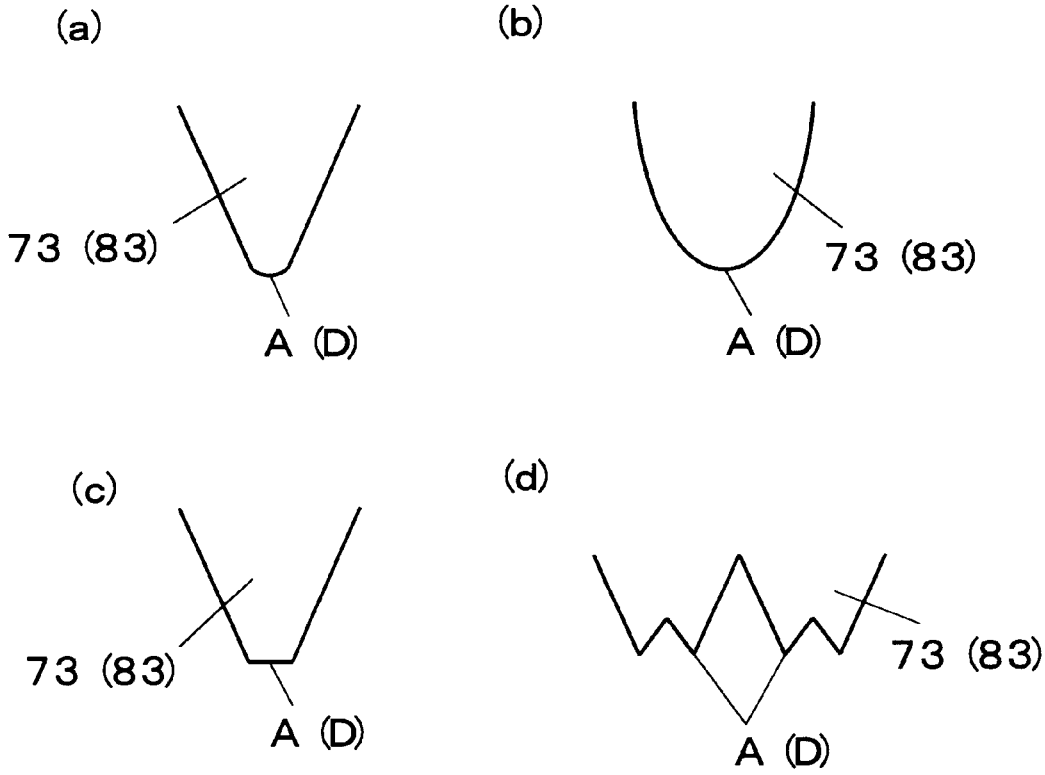
FIGS. 9(*a*) to 9(*d*) are main part side views showing modified examples of prism portions.

Besides, in the embodiments, the prism sheets 7 and 8 having the prism portions 73 and 83 with the V-shaped sectional shapes are used, however, the shapes of the prism portions 73 and 83 are arbitrary as long as the pair of hem sides (inclined surfaces) B, C, E and F intersecting at the tops A and D are provided, and for example, as modified examples of the prism portions 73 and 83, as shown in FIGS. 9(*a*) to 9(*d*), the tops A and D may be arc-shaped (FIG. 9A), the whole sectional shape may be substantially U-shaped (FIG. 9B), may be substantially trapezoid-shaped (FIG. 9C), or may be substantially W-shaped (FIG. 9D).

Figure 10:
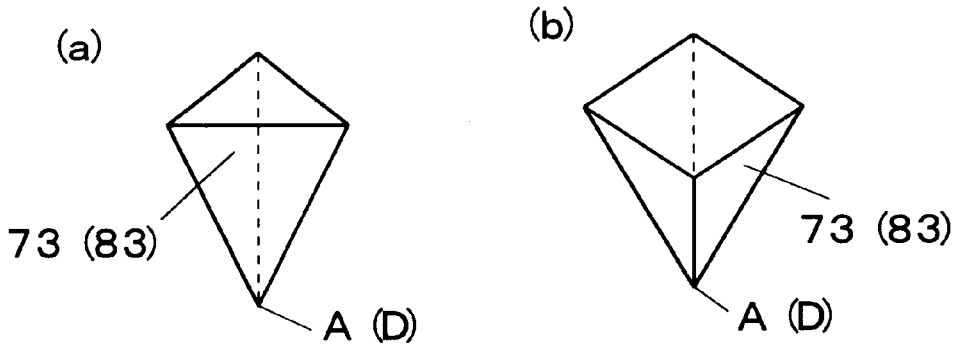
FIGS. 10(*a*) and 10(*b*) are main part perspective views showing other modified examples of prism portions.

Besides, in the embodiments, with respect to the structures of the prism portions 73 and 83, the examples have been described in which the top edge lines A1 and D1 are extended in parallel or concentrically to form the row shape, however, as other modified examples of the prism portions 73 and 83, as shown in FIGS. 10(*a*) and 10(*b*), a pyramidal shape having a plurality of inclined surfaces intersecting with each other at the top (vertex) A, D is formed, and the prism sheets 7 and 8 on which plural such pyramid-shaped prism portions 73 and 83 are disposed can also be used.

Besides, when the prism portions 73 and 83 in which the top edge lines A1 and D1 are extended in parallel with each other to form the row shape are combined with the light emitting element 5 made of a linear light source, it is advantageous to make an arrangement so that the edge lines A1 and D1 of the prism portions 73 and 83 become parallel with the axial line in the longitudinal direction of the light emitting element 5.

Besides, when the prism portions 73 and 83 in which the top edge lines A1 and D1 are concentrically extended to form the row shape is combined with the light emitting element 5 made of a dot-like light source, it is advantageous to dispose the light emitting element 5 at the center of the prism portions 73 and 83.

Besides, in the foregoing respective embodiments, although the description has been given while the backlight device of the present invention is the backlight device 2 for the liquid crystal display panel, the object of the illumination of the backlight device 2 of the present invention is arbitrary.

POSSIBILITY OF INDUSTRIAL USE

The present invention can be used for not only a backlight device for illuminating a liquid crystal display panel, but also a backlight device for illuminating an arbitrary panel display body.

What is claimed is:

1. A backlight device comprising:

a translucent sheet having light diffusibility;

a light emitting element disposed behind the translucent sheet; and a prism sheet disposed between the light emitting element and the translucent sheet and having a prism surface on which a plurality of prism portions each having at least a pair of inclined surfaces intersecting with each other at a top are formed, and a plane surface portion formed on a surface opposite to the prism surface, characterized in that the prism sheet includes a first prism sheet and a second prism sheet disposed away from each other, a prism surface of the first prism sheet is faced toward the light emitting element, and a prism surface of the second prism sheet is faced oppositely from the first prism sheet, wherein top edge lines of the prism portions of the first prism sheet and top edge lines of the prism portions of the second prism sheet are extended in parallel with each other.

2. A backlight device comprising:

a light emitting element;

a prism sheet disposed in front of the light emitting element and having a prism surface on which a plurality of prism portions each having at least a pair of inclined surfaces intersecting with each other at a top are formed, and a plane surface formed on a surface opposite to the prism surface; and a translucent sheet disposed in front of the light emitting element and having light diffusibility, characterized in that the prism sheet includes a first prism sheet and a second prism sheet disposed away from each other, a prism surface of the first prism sheet is faced toward the light emitting element, a prism surface of the second prism sheet is faced oppositely from the first prism sheet, and the translucent sheet is disposed behind the second prism sheet and away from the first prism sheet, wherein top edge lines of the prism portions of the first prism sheet and top edae lines of the prism portions of the second prism sheet are extended in parallel with each other.

3. A backlight device according to claim 1, comprising:

a translucent sheet having light diffusibility;

a light emitting element disposed behind the translucent sheet; and a prism sheet disposed between the light emitting element and the translucent sheet and having a prism surface on which a plurality of prism portions each having at least a pair of inclined surfaces intersecting with each other at a top are formed, and a plane surface portion formed on a surface opposite to the prism surface, characterized in that the prism sheet is disposed away from the light emitting element and the translucent sheet so that the prism surface is faced toward the light emitting element and top edge lines of the respective prism portions are concentrically extended to form a row shape.

4. A backlight device according to claim 2, characterized in that the light emitting element is a dot-like light source.

5. A backlight device according to claim 4, characterized in that the light emitting element is a light emitting diode.

6. A backlight device according to claim 1, wherein the first prism sheet refracts light in a direction away from a normal to a plane surface portion of the first prism sheet to diffuse the light in a wide range, and the second prism sheet refracts light from the first prism sheet directed away from the normal to the plane surface portion of the first prism sheet towards a normal to a plane surface portion of the second prism sheet.

7. A backlight device according to claim 2, wherein the first prism sheet refracts light in a direction away from a normal to a plane surface portion of the first prism sheet to diffuse the light in a wide range, and the second prism sheet refracts light from the first prism sheet directed away from the normal to the plane surface portion of the first prism sheet towards a normal to a plane surface portion of the second prism sheet.

* * * * *